US005408849A

United States Patent [19]

Schimko et al.

[11] Patent Number: 5,408,849

[45] Date of Patent: Apr. 25, 1995

[54] FLAT BED KNITTING MACHINE

[75] Inventors: Reinhold Schimko; Roland Wittwer, both of Westhausen, Germany

[73] Assignee: Universal Maschinenfabrik Dr. Rudolf Schieber GmbH & Co. KG, Germany

[21] Appl. No.: 90,126

[22] PCT Filed: Dec. 2, 1991

[86] PCT No.: PCT/EP91/02273

§ 371 Date: Jul. 20, 1993

§ 102(e) Date: Jul. 20, 1993

[87] PCT Pub. No.: WO92/13126

PCT Pub. Date: Aug. 6, 1992

[30] Foreign Application Priority Data

Jan. 25, 1991 [DE] Germany ..... 41 02 207.6

[51] Int. Cl.[6] ..... D04B 15/06

[52] U.S. Cl. ..... 66/106; 66/64

[58] Field of Search ..... 66/64, 104, 106, 60 R, 66/90

[56] References Cited

U.S. PATENT DOCUMENTS

| | | | |
|---|---|---|---|
| 1,653,886 | 12/1927 | Billings | 66/106 |
| 2,762,213 | 9/1956 | Schurich | 66/106 |
| 3,362,195 | 1/1968 | Goisis | 66/106 X |
| 4,713,948 | 12/1987 | Schmidt et al. | 66/106 |
| 4,827,739 | 5/1989 | Goller et al. | 66/106 X |
| 5,134,864 | 8/1992 | Yabuta et al. | 66/106 |
| 5,138,849 | 8/1992 | Stoll et al. | 66/104 |
| 5,231,854 | 8/1993 | Schmid et al. | 66/106 X |

*Primary Examiner*—John J. Calvert

*Attorney, Agent, or Firm*—Limbach & Limbach

[57] ABSTRACT

A flat bed knitting machine has at least one needle bed having mobile needles and stationary comb sinkers disposed in the needle bed. Movable holding-down sinkers are added to the needle bed to ensure that stitches are held in place.

15 Claims, 1 Drawing Sheet

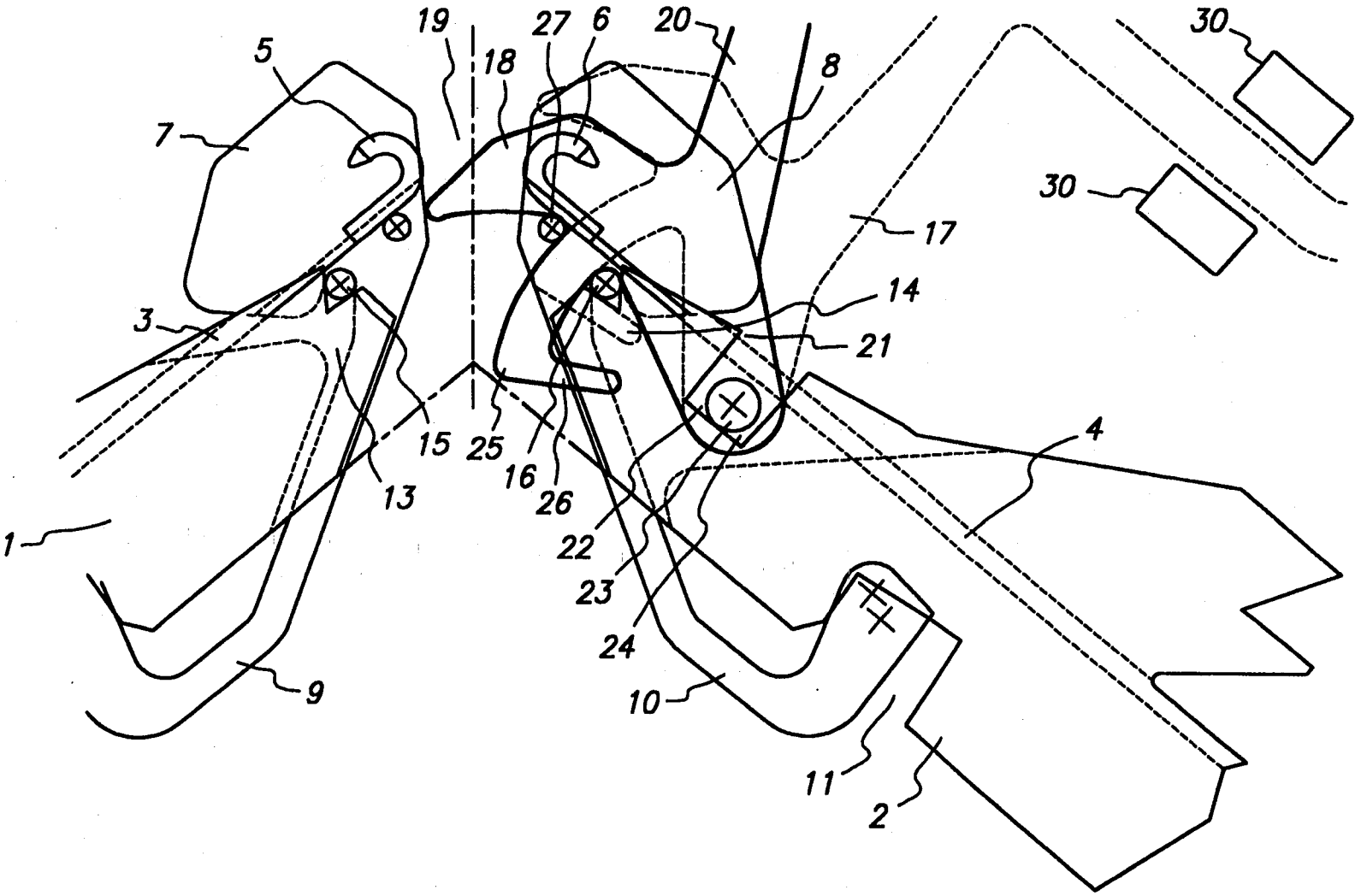
30
30
17
14
21
8
20
6
27
18
19
5
7
3
1
4
2
11
10
24
23
22
26
16
25
15
13
9

FLAT BED KNITTING MACHINE

The invention relates to a flat bed knitting machine including at least one needle bed having movable needles and stationary comb sinkers in the needle bed.

BACKGROUND OF THE INVENTION

Flat bed knitting machines of this type are generally known and are described for example in the book by Dieter Tollkühn "Flachstrick-automaten", 1979, publisher Meisenbach KG, Bamberg. Therein, the comb sinkers serve for the so-called "couliering" of the yarn wherein the thread taken up by the needle is held back during the withdrawal movement of the needle on the coulier (stitch-forming) edge of the comb sinker in order to form the stitch (c.f. e.g. pages 46 and 47 of the book). The comb sinkers, which are necessary for the formation of the stitch, may, for example, be stamped elements which are clipped into the needle bed. The comb sinkers may also however, as a part of the needle bed itself, be constructed as a single unit with the latter. In order to obtain a perfect knitted fabric, it is thereby necessary to exert a certain tension on each old stitch so that the stitches cannot move upwardly into the stitch forming region and be captured yet again by the needles. Consequently, the flat knitting machines have a fabric or stitch take-off device with which the old, finished stitches are removed.

Nowadays, there is a demand for flat knitting machines with which the most varied patterns can be knitted, for example knots, cable stitches or fancy trimmed knitted sections, for incorporation in the knitwear or attachment to the knitted fabric. It is necessary with these patterns however, that several stitches be located on one needle or that new stitches be incorporated into the stitches without taking-off the fabric. This has the result that the additional new stitches are not captured by the fabric or stitch take-off mechanism and thus are not drawn off. Consequently, especially with patterns of this type, there is a great danger that these additional stitches, upon which no tension is being exerted, will move upwardly into the region of stitch formation or needle movement.

So-called stitch pressers, in which a presser wire or finger in the camming region in the comb gap is simultaneously moved in the direction of movement of the cam and holds down the stitches not captured by the fabric or stitch take-off mechanism, have already been used. Apart from the fact that differently shaped pressers are also required for the different kinds of knitting and the different gauges, which entails a frequent swapping-over of the pressers, it is also especially disadvantageous that the pressers likewise have to be switched over upon the return of the carriage. Moreover, the wires of the presser are easily bent out of shape, come into contact with the latch brushes and impede the access to and the view into the comb gap.

Flat bed knitting machines are known for example from the publications DE-A 39 17 934, DE-PS 233 559, CH-PS 343 573, DE-AS 15 85 281, DE-A 20 61 502 or DE- A 36 09 539, in which the comb sinkers are constructed to be movable and, in this connection, are referred to as holding-down sinkers.

With these holding-down sinkers, it is possible to keep the loose stitches pressed down and also to keep them out of the region of stitch formation of the succeeding stitches or out of the region of needle movement. Thereby, the conventional holding-down sinkers have both the task of serving as comb sinkers, i.e. of providing the coulier edges for the stitch formation as well as holding the old stitches down and preventing expansion into the stitch forming region. On the basis of their function as coulier edges, they must therefore also be provided and put into operation, i.e. be controlled, even when a holding-down is not required, for example when simple fabrics not having additional loose stitches are being manufactured. Thus, an alternative operation, with and without holding-down sinkers, is not possible.

A further disadvantage of the conventional flat knitting machines having holding-down sinkers is that with two bedded holding-down sinkers, such types of holding-down sinkers together with the appertaining control devices are required on both beds. In their forward position, the holding-down sinkers thereby come more or less closely together and thus effect the holding-down of the stitches. The construction and manufacturing cost of these conventional flat knitting machines is high because for each bed, sinkers, sinker beds and corresponding control devices in the cams are required. Moreover, the control of the sinker movement has to be very exact due to the oppositely located holding-down sinkers which, once more, reduces the operational reliability or increases the cost for providing small tolerances.

SUMMARY OF THE INVENTION

The object of the invention is therefore, to develop a flat knitting machine which, with simple construction; manufacturing and control means, enables the reliable holding-down of stitches to be assured.

Starting from the flat knitting machine mentioned hereinabove, this object is achieved in accordance with the invention by means of movable holding-down sinkers which are provided in addition to the stationary comb sinkers.

With the feature in accordance with the invention, whereby further movable holding-down sinkers are provided in addition to the stationary comb sinkers, and, in contrast to conventional flat knitting machines, the function of holding-down and the function of stitch formation or couliering are completely separate. The stitch formation is effected by the stationary comb sinkers which form the coulier edges for the couliering process without them being responsible for the holding-down of the stitches. Thereby, the holding-down sinkers play no part in the stitch formation: they do not have coulier edges and are provided exclusively for the holding-down of the old stitches. By the utilisation of both stationary comb sinkers (which could also be constructed in one piece with the needle bed) and of additional holding-down sinkers, a clear splitting of the tasks between the formation of the stitches and the process of holding-down is therefore achieved. This provides substantially greater freedom to the designer of flat knitting machines since, so far as these items are concerned, he does not need to make compromises during the design and manufacture either of the comb sinkers or of the holding-down sinkers. Thus, he can choose the comb sinkers for the optimisation of the coulier edges and the formation of the stitches freely and independently from the shape of the holding-down sinkers and vice versa.

A further important advantage of the present invention, namely to provide movable holding-down sinkers in addition to the stationary comb sinkers, is that the holding-down sinkers can remain out of operation when a holding-down of the stitches is not required, for example when knitted fabrics are being made in which no loose stitches occur in the knitwear or pattern. In contrast to conventional holding-down sinkers which also form the coulier edges the stationary comb sinkers are therefore sufficient in these cases. The movable holding-down sinkers may then, when they are not required for the holding-down process, be held in the back position throughout the whole width of the machine by a control or restraining device. Thereby, the abrasion of the holding-down sinkers themselves as well as that of the cams required for the control of the holding-down sinkers is reduced. The functional reliability and the life of a flat knitting machine are thereby increased.

In accordance with a particularly advantageous embodiment of the invention, the movable holding-down sinkers incorporate a holding-down finger which covers the comb with respect to a needle bed in the forward position of the holding-down sinker. Thus, for the process of holding-down the stitches, holding-down sinkers are required on only one needle bed or, it is possible to only provide one holding-down sinker on each needle bed for each alternate needle or comb sinker so that only half the number of holding-down sinkers is thereby required without causing the effectiveness of the holding-down of the stitches to suffer thereby. Moreover, the possibility arises of being able to use differently shaped and/or controlled holding-down sinkers for the two needle beds in order to achieve a further optimisation of the holding-down of the stitches and/or of the stitch formation.

It is particularly advantageous however if the movable holding-down sinkers are only provided on one needle bed. Due to the fact that the comb gap is already covered by one holding-down sinker, i.e. two oppositely located holding-down sinkers of the conventional machines are not required, one can, in accordance with this embodiment of the invention, completely dispense with holding-down sinkers on one of the two beds so that the needle bed not having the holding-down sinkers only incorporates the conventional comb sinkers. This means, that as regards both the costs for the control of the sinkers as well as regards the sinkers and the sinker beds themselves, a substantial simplification of the flat bed knitting machine is achieved without thereby having to accept any restrictions in the functioning or reliability of operation. Since, with this embodiment, no devices for movable sinkers are required on one needle bed, there is also sufficient space for the measuring wheels when pile fabrics are being knitted i.e. knitting of pile knitwear can be carried out with the flat knitting machine in accordance with the invention.

In accordance with a further advantageous embodiment of the invention, the forward ends of the holding-down sinkers do not touch the stationary comb sinkers of the opposite needle bed. It is thereby ensured that the sinkers are not then damaged when they are located in the forward position by a displacement of the needle bed in the longitudinal direction of the machine i.e. during racking.

In accordance with a preferred embodiment of the invention, the shape and/or path of movement of the holding-down sinkers is selected such that they do not extend into the path of movement of the needles of the opposite needle bed. In this manner, it is ensured that contact with, and thus damage to or breakage of the needles and/or of the holding-down sinkers, cannot occur, independently of the racking position in which the needle beds are located.

Preferably, the simplest path of movement of the holding-down sinker is that specified when the holding-down sinker is rotatable about a pivot point.

In accordance with a further development of the invention, the holding-down sinker executes a combined rotational and longitudinal movement. In this manner, the path of movement of the holding-down sinker can be optimised in the light of the prevailing circumstances and a position in the forward location can be achieved which could not be achieved by an exclusively rotational movement. For example, it is thereby possible, if required, to select the holding-down finger in the forward position relatively high up without the path of movement of the holding-down sinkers thereby crossing the paths of movement of the oppositely located needles.

In order to achieve a combined rotational and longitudinal movement, it is provided in an advantageous manner that the holding-down sinkers include an elongated slot for the accommodation of the shaft. In this manner, there arises an eccentric rotation having a rotational and a longitudinal component of movement whereby the course of the movement and the position of the holding-down sinker or of the holding-down finger can be optimised in the light of the prevailing requirements and wishes.

In accordance with a further embodiment of the invention, the holding-down sinkers include a guide arm which moves in a guiding device. These features also permit a combined rotational and longitudinal movement of the holding-down sinker or of the holding-down finger with optimal matching of the course of the movement and the position of the sinkers to the prevailing circumstances. The guiding device thereby preferably comprises two wires which extend in the longitudinal direction of the machine and are provided in corresponding holes in the needle bed below the needle channels. The guide arm slides between these wires and its course of movement is thereby defined. Accordingly, defined and more or less complicated curves for the movement of the holding-down sinkers or of the holding-down fingers can be selected and achieved in a simple manner for the optimisation of the course of the movement, and/or of the positions to be adopted.

Preferably, the holding-down sinker has at least one stop element for the upper and/or lower limiting of the path of movement. The stop element is of advantage in particular for limiting the downward movement i.e. into the forward position. The end position of the holding-down sinkers is therefore defined and predetermined.

In accordance with a further advantageous embodiment of the invention, the holding-down finger, the holding-down sinker and/or the movement control means is flexed when pressure or tension is exerted by the stitches on the holding-down finger. The elasticity and the degree of flexing in the movement of the finger also reduces the danger of a break in the thread especially when a relatively great tension is exerted on the thread during a racking process and/or when transferring.

Various arrangements are possible for securing the holding-down sinkers. In one advantageous embodiment the comb sinkers and the holding-down sinkers are secured to a needle bed by a wire common to the two sinkers. In this manner, there is less expenditure both on machine components as well as with respect to the installation.

BRIEF DESCRIPTION OF THE DRAWINGS

The invention will be explained in detail hereinafter by means of an embodiment with reference to the single drawing.

DESCRIPTION OF THE PREFERRED EMBODIMENT

The FIGURE portrays a cross-section through the needle beds 1 and 2 of a flat knitting machine. Needles 5 and 6 are located in the needle channels 3 and 4 of the needle beds 1 and 2. For the sake of clarity, only the heads of the needles are illustrated. In this embodiment, both needle beds have the same comb sinkers 7, 8 which are clipped into corresponding recesses 11 in the lower side of the beds 1 and 2 by means of resilient arms 9 and 10 whereby the upper parts of the comb sinkers 7 and 8 formed with appropriate recesses 13 and 14 in the comb sinkers 7 and 8 are located over wires 15 and 16 running in the longitudinal direction of the beds. A holding-down sinker 17 is represented by a thick solid line in its forward position and by a dashed line in its rearward position. The holding-down sinker 17 is arranged on the one needle bed 2 of the flat knitting machine in addition to the comb sinker 8 and preferably in the near vicinity of it.

The holding-down sinker 17 incorporates a holding-down finger 18 which covers a comb gap 19 when the holding-down sinker 17 is in its forward position. Thereby, the forward end of the holding-down finger 18 does not touch the oppositely located bed or the oppositely located comb sinker. The old stitches already cast off from the needles 5 or 6 are securely held down by the finger 18 in the forward position of the holding-down sinker 17 and are then also prevented from getting into the driven-out region of the needles 5 or 6 above the holding-down finger 18 when the old stitches are not cast off, for example then, when they are not pulled off by a stitch or fabric take-off device, perhaps, for cam or other patterns where several stitches were knitted by one needle.

The holding-down sinker for the cam 30, which is provided for the control of the latter is moved by a control lever 20 into the forward or rearward position. The controlling of sinkers is generally known and is not the subject of the present, invention so that, in this connection, one can dispense with a detailed description of the control procedure.

In the illustrated embodiment, the holding-down sinker 17 includes a pivot arm 21 having a boring or a hole 22 through which a wire 23 is inserted as a shaft. As this embodiment shows, the wire 23 is located in a recess 24 in the needle bed whose inner dimensions are greater than the diameter of the wire 23.

The holding-down sinker 17 incorporates at the lower end, a guide arm 25 including a stop element 26 provided at the lower end which may also serve as the holding-down edge for the knitted fabric. During movement of the holding-down sinker 17, the guide arm 25 is guided between two wires 16 and 27 serving as a guiding device wherein the guide wire 16 is simultaneously the retaining wire for the comb sinker 8 and the guide wire 27 serves as a so-called knocking-over wire over which the finished stitches slide downwardly. Due to the shape of the guide arm 25 which is guided between the guide wires 16, 27, a curved movement of the holding-down sinker 17 and thus of the holding-down finger 18 is defined which corresponds to the given requirements or desired paths of movement. In particular, by use of the guide arm 25, it is possible to additionally obtain a longitudinal movement of the holding-down sinker 17 and thus of the holding-down finger 18 as well as a purely rotational movement about the shaft 23. To this end, the holding-down sinker 17 has an elongated slot (not illustrated) so that it can adapt to the longitudinal movement.

As is apparent from the drawing, one edge of the body of the holding-down sinker 17 strikes the guide wires 16 and/or 27 in the forward position of the sinker, which is indicated by thick solid lines in the drawing, so that the forward position of the holding-down sinker 17 and thus of the spacing of the holding-down finger 18 from the oppositely located needle bed or the oppositely located comb sinker 7 is thereby established. In the rearward position of the holding-down sinker 17 illustrated in dashed lines, the stop element 26 strikes the wire 16 so that the movement of the holding-down sinker 17 is thereby limited in the rearward position.

The invention has been described hereinabove by means of a preferred embodiment. However numerous configurations and modifications are possible for the skilled man without thereby departing from the spirit of the invention.

We claim:

1. A flat bed knitting machine including a first needle bed and a second needle bed each having movable needles and stationary comb sinkers connected thereto, the improvement comprising holding-down sinkers movably connected only to the first needle bed.

2. A flat bed knitting machine as in claim 1, further comprising a control device for disabling the holding-down sinkers.

3. A flat bed knitting machine as in claim 1, wherein, the holding-down sinkers each have a forward position and a rearward position, and wherein, each holding-down sinker incorporates a holding-down finger which covers a comb gap with respect to the first needle bed in the forward position of the holding-down sinker.

4. A flat bed knitting machine as in claim 3, wherein, the holding-down fingers have forward ends and the forward ends of the holding-down fingers do not touch the stationary comb sinkers of the second needle bed.

5. A flat bed knitting machine as in claim 3, further comprising movement control means for controlling movement of the holding-down sinkers, wherein, movement of the holding-down sinkers is controlled such that the sinkers are free from interference with the needles of the second needle bed.

6. A flat bed knitting machine as in claim 5, wherein, the holding-down finger, the holding-down sinker and the movement control means are flexible.

7. A flat bed knitting machine as in claim 1, wherein, the holding-down sinkers are rotatable about a pivot point.

8. A flat bed knitting machine as in claim 7, wherein, the holding-down sinkers include an elongated slot for accommodating a shaft.

9. A flat bed knitting machine as in claim 1, wherein, the holding-down sinkers execute a combined rotational and longitudinal movement.

10. A flat bed knitting machine as in claim 1, wherein, the holding-down sinkers include a guide arm which moves in a guiding device.

11. A flat bed knitting machine as in claim 1, wherein, at least one stop element is provided for limiting the movement of the holding-down sinkers.

12. A flat bed knitting machine as in claim 1, wherein, the comb sinker and the holding-down sinker are secured to a needle bed by a wire common to the comb sinker and the holding-down sinker.

13. A flat bed knitting machine, comprising:

a first needle bed;

a second needle bed adjacent the first needle bed;

a plurality of movable needles coupled to each needle bed;

a plurality of stationary comb sinkers coupled to each needle bed; and a plurality of holding-down sinkers movably coupled to the first needle bed, wherein the holding-down sinkers include a guide arm which moves in a guiding device, and wherein the guiding device includes at least two wires between which the guide arm slides.

14. A flat bed knitting machine as in claim 13, wherein, the wires are comb sinker clamping wires.

15. A flat bed knitting machine as in claim 13, wherein the wires are knocking-over wires.

* * * * *